US007965221B1

(12) United States Patent
Nardozza et al.

(10) Patent No.: US 7,965,221 B1
(45) Date of Patent: Jun. 21, 2011

(54) SELECTIVE DISRUPTOR FOR VOICE MODULATED COMMUNICATIONS

(75) Inventors: Vincent J Nardozza, Rome, NY (US); Marvin R Clinch, Oneida, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 04/868,979

(22) Filed: Oct. 22, 1969

(51) Int. Cl.
*H04K 3/00* (2006.01)

(52) U.S. Cl. ..... 342/15; 342/13; 455/1

(58) Field of Classification Search ..... 342/13–19, 342/175; 455/1, 7, 14, 18
See application file for complete search history.

(56) References Cited

U.S. PATENT DOCUMENTS 2,440,253 A * 4/1948 Dodington ..... 342/15
2,467,208 A * 4/1949 Hahn ..... 342/78
2,706,773 A * 4/1955 Dodington ..... 375/214
2,943,318 A * 6/1960 Busignies et al. ..... 342/15
2,978,699 A * 4/1961 Dodington ..... 342/15
3,015,096 A * 12/1961 Busingnies et al. ..... 342/15
3,019,433 A * 1/1962 White ..... 342/15
3,600,685 A * 8/1971 Doyle ..... 455/1
3,604,828 A * 9/1971 Perkovich ..... 434/5
3,760,417 A * 9/1973 Haeff et al. ..... 342/15
3,983,482 A * 9/1976 Doherty ..... 375/211
4,313,207 A * 1/1982 Nardozza et al. ..... 455/1
4,328,496 A * 5/1982 White ..... 342/15
H000510 H * 8/1988 Clinch ..... 340/5.84

* cited by examiner

*Primary Examiner* — Thomas H Tarcza
*Assistant Examiner* — Peter Bythrow
(74) *Attorney, Agent, or Firm* — AFMCLO/JAZ; Sherman H. Goldman

(57) ABSTRACT

A method and system for selectively disrupting voice modulated radio communications circuits wherein the original communication is recorded, delayed for a selected period then synchronized with a transmitted signal and reinjected into the transmitted signal thereby preventing the intended recipient of the signal from obtaining any intelligence therefrom.

4 Claims, 1 Drawing Sheet

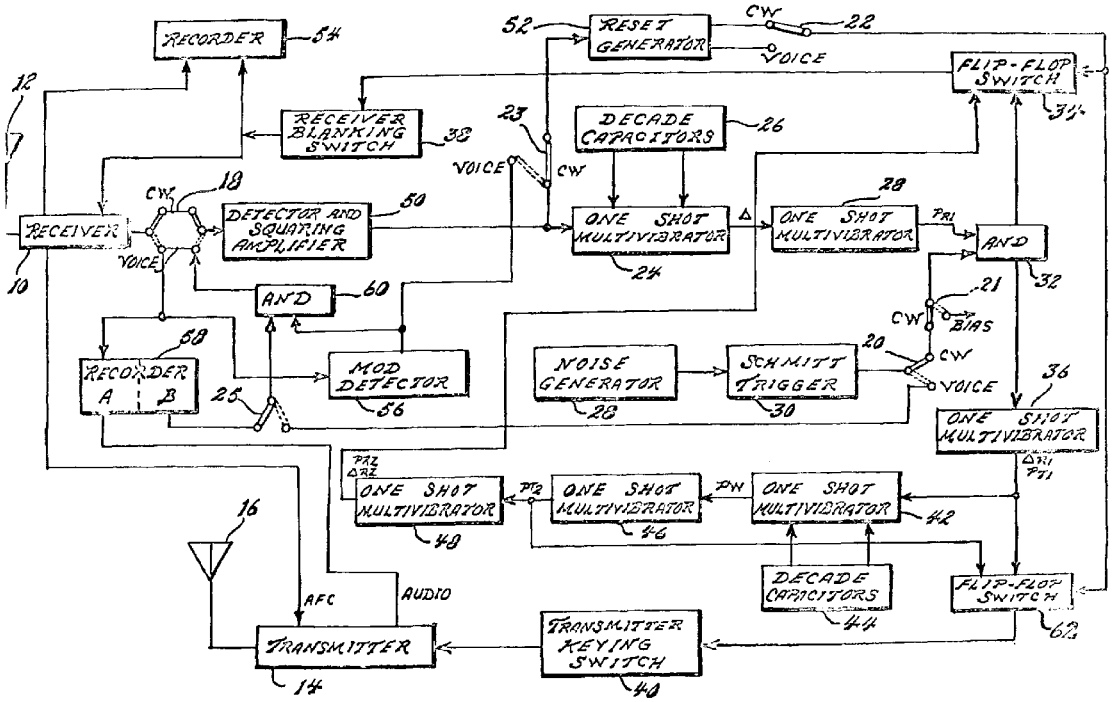

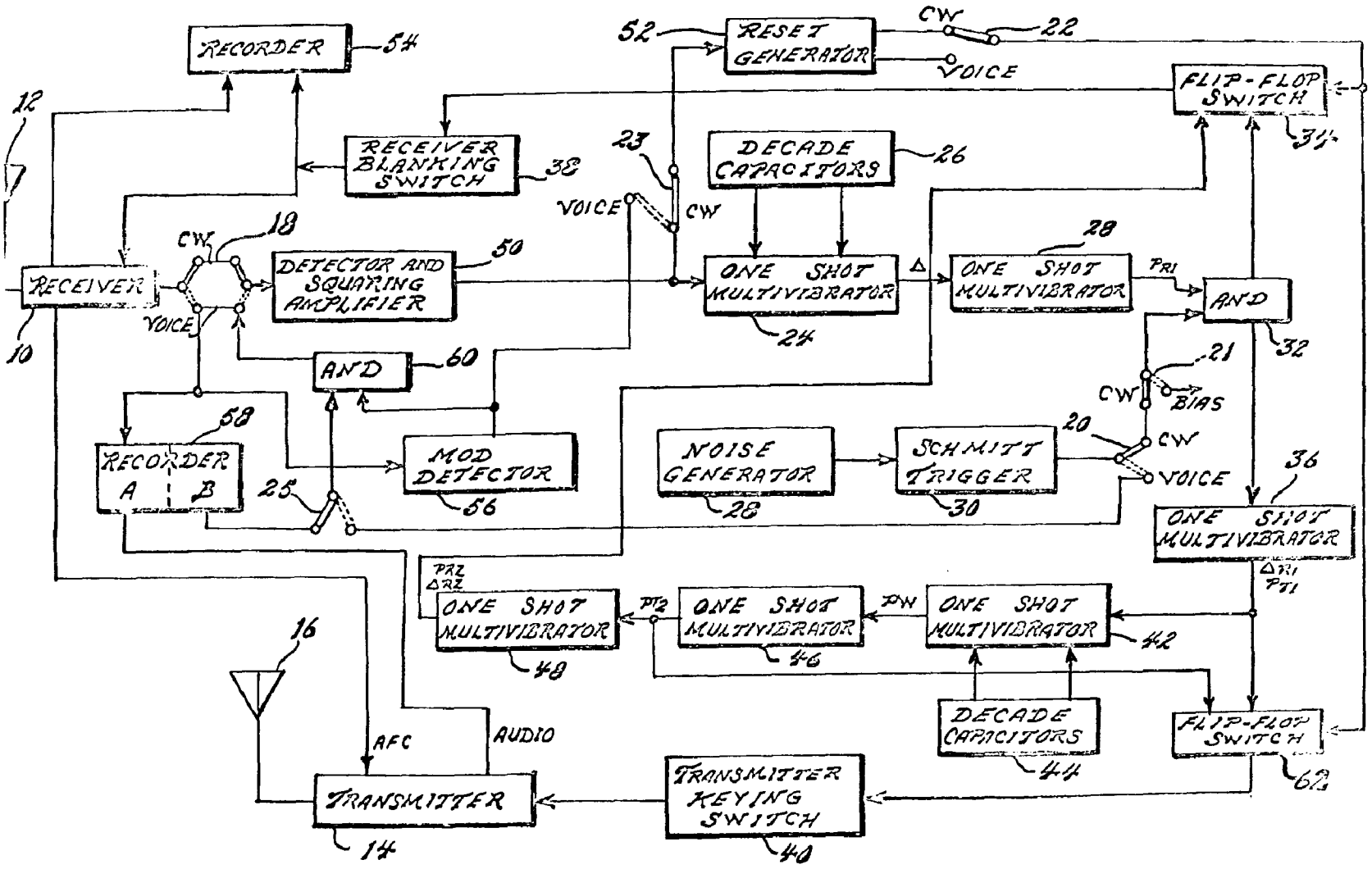
FLIP-FLOP SWITCH
AND
ONE SHOT MULTIVIBRATOR
FLIP-FLOP SWITCH
ONE SHOT MULTIVIBRATOR
DECADE CAPACITORS
SCHMITT TRIGGER
RESET GENERATOR
DECADE CAPACITORS
ONE SHOT MULTIVIBRATOR
ONE SHOT MULTIVIBRATOR
NOISE GENERATOR
ONE SHOT MULTIVIBRATOR
TRANSMITTER KEYING SWITCH
ONE SHOT MULTIVIBRATOR
RECEIVER BLANKING SWITCH
DETECTOR AND SQUARING AMPLIFIER
MOD DETECTOR
AND
RECORDER
RECORDER
TRANSMITTER
RECEIVER
BIAS
CW
VOICE
AUDIO
AFC

SELECTIVE DISRUPTOR FOR VOICE MODULATED COMMUNICATIONS

BACKGROUND OF THE INVENTION

This invention relates generally to a system for selectively disrupting communications and more specifically to a method and system for disrupting voice modulated radio communications commonly known as the telephone.

The radio telephone conveys intelligence by virtue of the phonetic content of the speaker's voice. In disrupting such communication, experience has shown that a substantial problem arises where the disruption is desired to appear as originating from natural causes. Complete disruption would cause those attempting to communicate to automatically take counter measures as, for example, to switch to a prearranged alternate channel. Selective disrupting, if it can be made to look natural, will allow the parties to communicate but will not allow the transmission of intelligible information while at the same time not being severe enough to cause the parties to automatically switch to an alternate channel or take effective countermeasures. Where the signal is voice modulated it is difficult to substitute a disrupting signal without having it immediately reorganized as an attempt to break up the transmission; however, where the speaker's voice is utilized to provide the disrupting signal, it is less likely to be recognized as an attempt to deliberately interrupt the communication.

In addition to providing a source of natural appearing electromagnetic radiation for disrupting communication it is very desirable in many instances to be able to recover the original intelligence from the disrupted signals. Generally, communications jamming systems presently in existence lose the originally transmitted signal with no means for recovering the intelligence that was attempted to be communicated. This intelligence may be of great importance during times of national crises and the ability to recover this information may provide persons in positions of authority with a better insight as to an actual situation and thus the ability to make a more informed decision on matters of particular importance.

SUMMARY OF THE INVENTION

This invention provides a means for altering or disrupting the intelligence of a transmitted voice signal through the addition of a disrupting signal. The disrupting signal consists of a retransmission of the original signal which has been recorded and delayed. This addition deprives the intended recipient of the original intelligence, however, the disruptor retains the ability to extract the original intelligence from the disrupted signal, inasmuch as the disruptor knows both what has been added and when it was added to the original signal.

The invention alternatively provides the capability of disrupting telephone wire communication signals in substantially the same manner as hereinafter described, however, suitable substitutions are required to be made for the radio receiver and transmitter units.

In the case of voice modulation, this invention utilizes a suitable radio receiver and transmitter. In addition, a two-channel magnetic tape loop recorder to record, delay and synchronize the injected voice signal are utilized. Also required are a modulation activity detector, a switch, and one additional "And" gate.

In operation the detected receiver output of the signal to be disrupted is recorded on one channel of the loop recorder. A single timing pulse, prerecorded on the second channel of the loop recorder, establishes one basic time unit of the system, (one revolution of the tape loop). This pulse is synchronized with the system control logic which in turn selects recorder functions (record and playback) and the transmitter on-off keying. The system control logic, the speed of the tape loop past the recorder heads, the length of the tape loop, and the physical separation between the record and playback heads, determine the basic unit time limits of the system. One application of the technique is as follows:

A portion of the modulated signal of the communications circuit to be disrupted is recorded on the recording loop, the input to the magnetic record head is turned off, the transmitter turned on, and the recorded signal is retransmitted after a selected delay time (T). After the recorded signal has been retransmitted one or more times (as controlled by the system control logic), the transmitter is turned off and a new portion of the unaltered signal is recorded and the above cycle is repeated. A modulation activity detector is provided to insure that the transmitter does not generate a disrupting signal when the signal to be disrupted does not contain intelligence.

Alternatively, the mode of operation could be changed whereby portions of the signal to be disrupted would be sequentially stored on separate channels of a multi-channel loop recorder. By selecting relatively long delay times and retransmission periods, the contents of one or more recorded channels can be retransmitted to form incoherent phrases during pauses in the modulated signal which is to be disrupted.

This invention enables an operator to selectively disrupt radio telephone communications circuits through the random addition of disruptive characters to the message content on the circuit's operating frequency, although no other circuits are affected by the operation of the invention.

Additionally, the invention inserts disruptive elements which, through selective pulse width and delay, are formed to resemble elements within the originally transmitted signal.

Further, this invention requires that the signal level of the inserted signal, at the intended recipient's receiver, need only match or slightly exceed the level of the original signals to be effective. The required radiated power of the disrupting transmitter is therefore relatively low compared to the power required by conventional jamming techniques.

The invention denies useful intelligence to the intended recipients while the party responsible for disrupting the signals has the capability to recover the original intelligence.

The detection of the disrupting signal for electronics counter countermeasures purposes is extremely difficult and unlikely since the cause of the disruption could reasonably be attributed to unintentional sources.

It is therefore an object of this invention to provide a new and improved system for selectively disrupting voice modulated radio communications.

It is a further object of this invention to provide a new and improved method and apparatus for disrupting radio telephone communications by selectively inserting known signals into a transmitted message.

It is another object of this invention to provide a new and improved method and system for disrupting radio telephone communications which require a minimum amount of radiated power.

It is still a further object of this invention to provide a new and improved system for disrupting voice modulated communications which requires only a small bandwidth.

It is still another object of this invention to provide a new and improved communication disruptive system wherein the party disrupting the communication has the capability of gathering the intelligence from the signal as originally transmitted.

These and other advantages, features and objects of the invention will become more apparent from the following description taken in connection with the illustrative embodiment in the accompanying drawing, wherein:

DESCRIPTION OF THE DRAWING

The FIGURE is a block diagram of a preferred embodiment of the invention.

DESCRIPTION OF THE PREFERRED EMBODIMENT

Referring now to the FIGURE, a system is shown in which there is provided a means for disrupting continuous wave communications as well as voice modulated communications, the improvement being in the latter. A normally "on" receiver is shown at 10 with its antenna 12. A normally "off" transmitter 14 is connected to its associated antenna 16. Receiver 10 is arranged to be gated off and transmitter 14 to be gated on. The receiver 10 obtains its signals through its antenna 12. The output of receiver 10 is fed to detector and squaring amplifier 50 for shaping of the received radio telephone modulation.

With switches 18, 20, 22 and 23 in the continuous wave position, the one-shot multivibrator 24 initiates a time delay (Δ) on the trailing-edge of the shaped pulses. This delay can be varied by the selection of an appropriate capacitance from the decade capacitor 26 which is arranged and connected with one-shot multivibrator 24 to permit a switching change of the capacitance therein which determines the delay thereof. This delay determines the time separation between the trailing-edge of the received pulse and the leading-edge of the disruptive pulse. The trailing-edge of the pulse from one-shot multivibrator 24 initiates a pulse from one-shot multivibrator 28.

In order that the intended recipient not sense a fixed relationship between the original signal characters and the disruptive characters a random nature is imparted upon the occurrence of the disrupting pulses by multiplying the output of the one-shot multivibrator 28 with a random noise source output.

Noise generator 28 produces a series of short duration voltage transients which are random in both amplitude and occurrence. Adjustment of the threshold level of Schmitt trigger 30 controls the random rate of the output pulses of the Schmitt trigger, i.e. at low threshold levels the Schmitt trigger will fire more frequently. When the outputs of one-shot multivibrator 28 and the Schmitt trigger 30 are in coincidence, AND GATE 32 generates an output pulse. This pulse triggers flip-flop multivibrator 34 and one-shot multivibrator 36.

Flip-flop multivibrator 36, when set by the trailing-edge of the pulse from AND gate 32, turns on receiver blanking switch 38 which turns receiver 10 off and precludes any signal reception.

The multivibrator 36, triggered by the trailing-edge of the pulse from AND gate 32, generates a small delay ($\Delta R_1$) sufficient to allow receiver 10 to turn completely off before the transmitter 14 is turned on. The trailing-edge of the pulse from one-shot multivibrator 36 sets the transmitter flip-flop multivibrator 62. The output of flip-flop multivibrator turns on transmitter keying switch 40 which in turn activates transmitter 14.

The one-shot multivibrator 42 is also triggered by the pulse from multivibrator 36. This one-shot multivibrator determines the width of the disrupting pulse. This pulse width is controlled by selection of the appropriate capacitance from decade capacitor 44. Decode capacitor 44 is interconnected with one-shot multivibrator 42 to enable a variation of the capacitance which determines pulse width.

The one-shot multivibrator 46 receives the output from one-shot multivibrator 42 and in turn provides an output which resets transmitter flip-flop multivibrator causing transmitter 14 to turn off. One-shot multivibrator 46 receives the output from one-shot multivibrator 48 and initiates a short delay ($\Delta R_2$) sufficient to allow transmitter 14 to turn completely off prior to the turn-on of receiver 10. The trailing-edge of flip-flop multivibrator 48 resets flip-flop multivibrator which turns on receiver 10 through blanking switch 38.

To prevent the receiver 10 from turning off and transmitter 14 from turning on during the reception of a pulse by receiver 10, an inhibit circuit is included in the logic. The output of detector and squaring amplifier 50 causes reset generator 52 to hold both flip-flop multivibrators 34 and 62 in the reset state, i.e. receiver 10 "on" and transmitter 14 "off".

The original intelligence can be recorded on the recorder 54 from the audio output of the receiver 10 thereby providing a source of intelligence prior to the insertion of the disruptive signals.

When the invention is to be utilized for the disruption of modulated signals the switches 18, 20, 21, 22, 23, and 25 are placed in the "voice" position shown in phantom in the drawing. The output of the receiver 10 is then applied to both the modulation activity detector 56 and channel "A" of the loop tape recorder 58. The modulation activity detector 56 generates a continuous DC signal only when modulation is present within the receiver (10) audio output. This output is applied to the "And" gate 60. The "B" channel of the tape recorder 58 contains a prerecorded single pulse per revolution of the loop. When the output of the modulation activity detector 56 and the pulse from the recorder "B" channel both occur, the "And" gate 60 furnishes an input to the squaring amplifier 50. The control logic following then operates identically to the continuous wave case in that timing and width are controlled by the one-shot multivibrator 24 and one-shot multivibrator 42. The output of the reset generator 52 must have the capability of being inverted by the switch 22. The option of disruption by adding prerecorded signal segments over the original signal or the addition of prerecorded signal segments within pauses of the original signal can then be exercised by the operator. The flip-flops 34 and 62 are inhibited from the transmit mode when no signal is received for the voice case. When the transmitter 14 is turned on by the switch 40 the input to the transmitter modulator is furnished by the tape loop playback head (58) channel "A". The input to the "And" gate 32 is a DC bias, thus providing an output from "And" gate 32 upon a pulse from the multivibrator 28.

The system is provided with flexibility of operation by the use of the noise generator 28 and Schmitt Trigger 30 to supply a variable pulse rate to "And" gate 60, thereby insuring an unsynchronized injection rate.

Additional timing flexibility can be provided by inserting a preset, but adjustable, count-down counter between recorder 58 (channel B) and the switch 25. The rate of injection could then be reduced to any submultiple of the loop recorder pulse rate.

Having thus described a system for selectively disrupting voice modulated communications, we claim the following as our invention:

1. A system for selectively disrupting modulated radio communications comprising: a normally on receiver means for receiving radio signals; modulation detector means connected to the receiver for detecting the presence of a modulated signal; dual channel recording means connected to said receiver for recording the modulated signal; a first AND gate connected to the modulation detector and the recording means whereby an output from the first AND gate will be generated upon simultaneous signals from the recorder and modulation detector; means for detecting and shaping pulses connected to the first AND gate; a first monostable multivibrator means connected to said detector and shaping means and providing a singular output pulse in response to each input pulse; variable delay means connected to the first multivibrator means whereby the trailing edge of said output pulse is delayed a predetermined time with respect to the trailing edge of said input pulse; a second monostable multivibrator means providing a singular output pulse in response to the trailing edge of the output pulse of said first monostable multivibrator; a source of DC bias voltage; a second AND gate connected to, and having as inputs, the source of DC bias and the second monostable multivibrator and providing an output upon coincidence of said inputs; a first bistable multivibrator means triggered by the trailing edge of the output from said second AND gate and producing an output pulse, receiver blanking means receiving said output pulse and thereupon turning said receiver means off, a third monostable multivibrator triggered by the trailing edge of the output pulse from said second AND gate;

a second bistable multivibrator means receiving the output pulse from said third monostable multivibrator and providing an output pulse in response thereto; a normally off transmitter tuned to the same frequency as the receiving means connected to said second bistable multivibrator; means associated with said transmitter for turning said transmitter on upon receiving a pulse from the second bistable multivibrator after said receiver means is turned off; means connecting said dual channel recording means to the transmitter whereby the transmitter will transmit the signals recorded when transmitter is turned on; and first and second reset means connected to the transmitter and receiver for returning each to its normal state after the transmission is completed.

2. A system for selectively disrupting modulated radio communications according to claim 1 wherein said first reset means comprises: a fourth monostable multivibrator means triggered by the output pulse of said second AND gate, said fourth means determining the length of the disrupting transmission; a fifth monostable multivibrator means triggered by the output pulse of said fourth means, said fifth means providing an output pulse to reset said second bistable multivibrator.

3. A system for selectively disrupting modulated radio communications according to claim 2 including: a variable decade capacitor operatively associated with said fourth monostable multivibrator for varying the width of its output pulse.

4. A system for selectively disrupting modulated radio communications according to claim 2 wherein said second reset means comprises: a sixth monostable multivibrator means connected to said fifth monostable multivibrator means triggered by the output pulse therefrom, the output from said sixth means providing the reset pulse for first bistable multivibrator.

* * * * *